United States Patent [19]

Moon

[11] Patent Number: 4,726,491

[45] Date of Patent: Feb. 23, 1988

[54] PULLOUT SPOUT CONTAINER AND METHOD

[76] Inventor: James R. Moon, Rte. 7, Old Ansel School Rd., Greer, S.C. 29651

[21] Appl. No.: 850,713

[22] Filed: Apr. 11, 1986

[51] Int. Cl.[4] ..... B65D 25/44

[52] U.S. Cl. ..... 222/1; 222/525; 222/529; 222/530; 222/538

[58] Field of Search ..... 222/525, 530, 538, 527, 222/529, 1

[56] References Cited

U.S. PATENT DOCUMENTS

| | | | |
|---|---|---|---|
| 3,250,428 | 5/1966 | Rieke | 222/538 X |
| 3,310,206 | 3/1967 | Littlefield | 222/525 |
| 4,076,151 | 2/1978 | Littlefield | 222/525 |
| 4,311,259 | 1/1982 | Babiol | 222/538 X |

FOREIGN PATENT DOCUMENTS

| | | | |
|---|---|---|---|
| 2401070 | 4/1979 | France | 222/538 |
| 2436721 | 5/1980 | France | 222/538 |
| 2028286 | 3/1980 | United Kingdom | 222/525 |

*Primary Examiner*—Joseph J. Rolla

*Assistant Examiner*—Frederick R. Handren

*Attorney, Agent, or Firm*—Cort Flint

[57] ABSTRACT

A pour spout container with a pour spout which may be pulled out of the container is disclosed as including a container (10) and a pour spout (24, 48). The sealing cap (20, 50) is provided for sealing the container and the pour spout. Threads (16, 22) are formed between the cap and a container neck (12). Threads (30, 32) are formed between an inner cap (**20*a*, 50*a*) and pour spout (24, 48). Turns of threads (30, 32) are greater than the turns of threads (16, 22**) so that the sealing cap may be removed from the container while remaining attached to the pour spout. Grasping of the cap may be utilized to extend the pour spout fully from the container without contacting the pour spout which has been in contact with the fluid in the container. Thereafter the cap may be removed from the pour spout for dispensing fluid. For this purpose, the pour spout is prevented from turning relative to the container so that unthreading thereof can be accomplished without grasping the pour spout.

7 Claims, 7 Drawing Figures

Fig. 5.
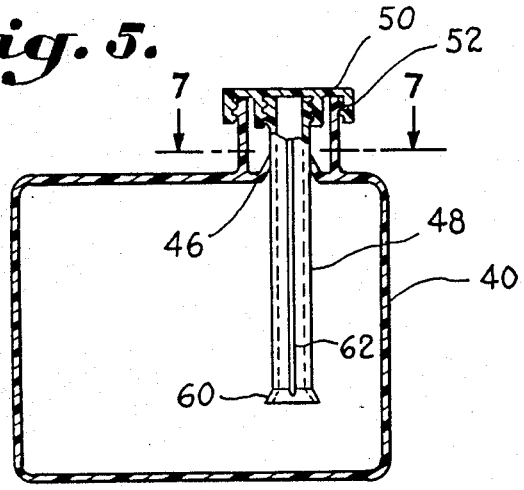
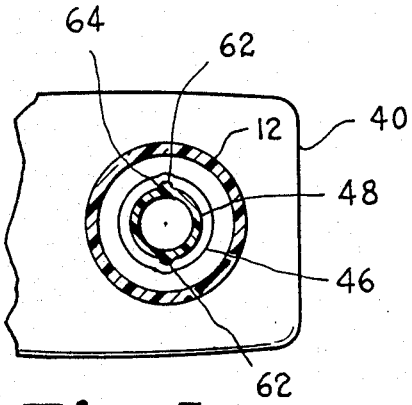
Fig. 7.
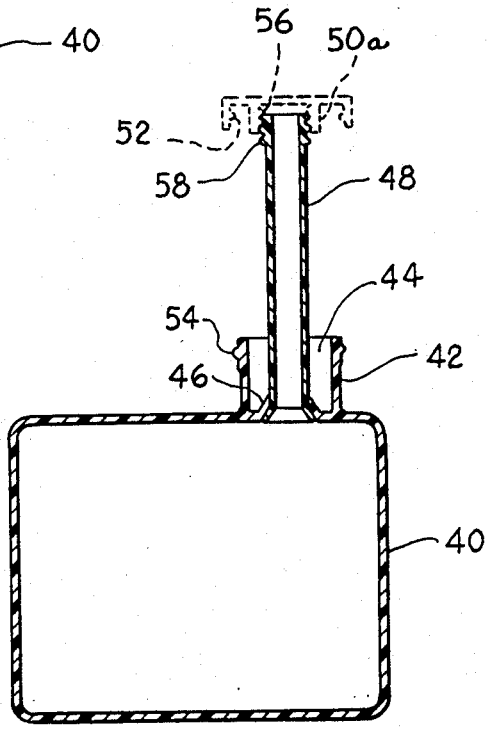
Fig. 6.
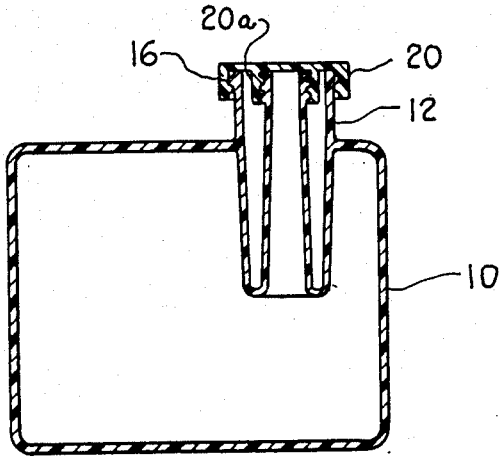
Fig. 4.

PULLOUT SPOUT CONTAINER AND METHOD

BACKGROUND OF THE INVENTION

This invention relates to a container and method of dispensing a fluid such as an automatic transmission fluid from a container in a manner that a funnel or other accessory device is unnecessary.

Many times it is necessary to pour fluid from a container into a filling opening which is remote and limited in access. Particularly, in automobile engines the filling opening for transmission fluid and oil is often disposed in an inconvenient location. Either a long-necked funnel or other accessory device need be inserted in the filler opening so that the fluid may be poured from the container into the filler opening. Many times a funnel or other device is not available making it difficult if not impossible to pour the container contents into the filler opening.

Heretofore, containers with pouring spouts which may be removable or extendable have been known such as in U.S. Pat. Nos. 2,736,469 and 1,473,925, and 1,631,951.

U.S. Pat. No. 3,181,745 discloses a container having a tube which may be removed from the container and affixed to the container in a manner that the fluid may be poured into the filling opening.

However, the above do not provide a satisfactory container and pour spout configuration for many applications such as automobile fluids. Moreover, to utilize many containers it becomes necessary to handle the spout after it has been immersed into the fluid. Fluids such as engine oil and transmission fluids do not clean easily from the hands. When the fluid is being added by self-service it is particularly troublesome to use a spout such as disclosed in the prior art. Many stations do not have hot water and soap that is needed to remove the fluids from the hands and most of the time the self-service user is dressed in clothing which he does not wish to soil.

Accordingly, an important object of the present invention is to provide a pour spout container which may be stored in the container and cleanly removed outwardly therefrom to pour a fluid into a remote filling opening.

Still another object of the invention is to provide a pour spout container in which the pour spout may be removed from the container interior without the necessity of handling the pour spout directly by hand.

Another object of the invention is to provide a pour spout container and method for dispensing the fluid from the container by which a pullout pour spout may be extended from the container without handling of the fluid contaminated area of the pour spout so that dispensing may be done with clean hands.

SUMMARY OF THE INVENTION

The above objectives are accomplished according to the invention by providing a pour spout container having a pullout pour spout which may be extended from the container for dispensing fluid to a remote filling opening. Most advantageously, the pour spout may be pulled out from the container by means of a container sealing cap which is attached both to the container and to the pour spout. The cap is attached to the container and pour spout in a manner that the cap may be removed from the container without being removed from the pour spout whereby the cap may be grasped to pull out the pour spout. Preferably, threads are provided attaching the cap to the container and pour spout and the threads between the pour spout and the cap include a larger number of turns whereby the cap may be unthreaded from the container by remaining threaded to the pour spout. After the pour spout has been extended from the container by grasping the cap the cap can then be unthreaded from the pour spout. Means for preventing the pour spout from rotating relative to the pour spout while the cap is unthreaded are provided. In the above manner, an extendable pour spout is provided for dispensing fluid into remote and inacessible filling openings in a clean and convenient manner.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 4 is a sectional view of the pour spout container of FIG. 3 with the pour spout enclosed;

FIG. 5 is a sectional view of an alternate embodiment of a pour spout container and method according to the invention;

FIG. 6 is a sectional view of the pour spout container of FIG. 5 with the pour spout extended; and FIG. 7 is a sectional view taken along line 7—7 of FIG. 5.

DESCRIPTION OF A PREFERRED EMBODIMENT

Figure 1:
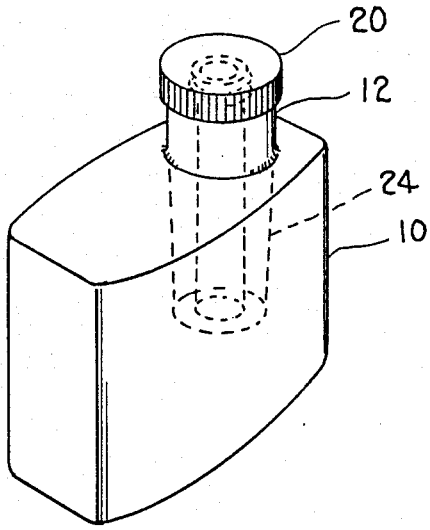
FIG. 1 is a perspective view illustrating a pour spout container constructed in accordance with the present invention with spout enclosed.

Referring now in detail to the drawings, a pour spout container is illustrated as including a container 10 having a neck 12 with an opening 14. The container and neck are preferably formed from a plastic material.

On the outside of neck 12 are threads 16. There is a cap 20 having internal threads 22 which threadably mate with threads 16.

Figure 2:
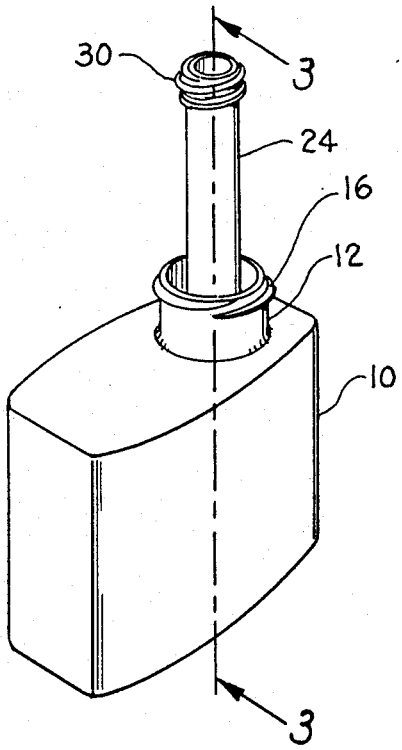
FIG. 2 illustrates a perspective view of a pour spout container and method according to the invention with spout extended.
Figure 3:
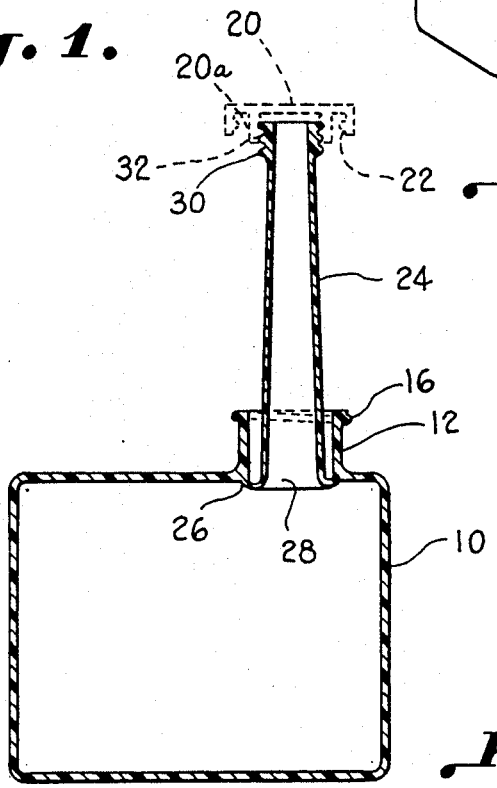
FIG. 3 is a sectional view taken along line 3—3 of FIG. 2.

As can best be seen in FIGS. 2 and 3, there is a pullout spout 24 which is initially retracted and enclosed in the container when capped. Pullout spout 24 may be affixed to the interior of container 10 such as in a manner that the two are one piece as can best be seen in FIG. 3. Thus there is continuous sealing web at 26 around the interior end of opening 14 so that fluid passes through opened end 28 of pullout spout 24. The web uniting the spout and container provides means for preventing the spout for turning relative to the container during cap removal.

First and second thread means are provided for threadably attaching sealing cap 20 and neck 12, respectively. Third and fourth thread means are provided for threadably attaching inner cap **20*a* and pout spout 24. At a remote end of pullout spout 24 there are external threads 30 which mate with threads 32 carried on an inner cap 20*a* of cap 20. The threads 32 and 30** include more turns than the threads 16 and 22. For example, there may be three turns of threads 30, 32 and only one turn of threads 16, 22. In this manner, cap 20 may be turned and released from neck 12 while still retained on the dispensing end of pullout spout 24.

Once the pullout spout is fully extended, the cap 20 may be removed further by additional turning and separation of threads 30 and 32. In this manner, the spout may be retracted without the need of handling that portion of spout 24 which has been retracted within the interior of container 10 and in contact with fluid. The user may withdraw the pullout spout without getting his hands dirty and dispense the fluid into a filling opening. This provides an excellent container and method for dispensing automatic fluids such as motor oil and automotive transmission fluid.

FIG. 4 illustrates the container with pour spout in a retracted configuration with sealing cap 20 in place about both the pour spout and the container neck. FIG. 3 illustrates the pour spout in a fully extended configuration where the sealing cap 20 may be removed from the dispensing end of the pour spout as described above.

Referring now to FIGS. 5 through 7, an alternate embodiment of the invention is illustrated wherein an extending pour spout 48 is provided that is not made as one piece with the container. There is a container 40 illustrated having a neck 42. There is an opening 44 formed in the neck. A cone-shaped outlet 46 is formed in the upper container wall within opening 44 of neck 42 with spout 48 slidably carried in the outlet 46.

As can best be seen in FIG. 5, there is a sealing cap 50 having internal threads 52 which threadably mate with threads 54 formed externally on neck 42. There is an inner cap 50*a* inside sealing cap 50 which includes threads 56 which mate with threads 58 externally formed on the end of pour spout 48.

As can best be seen in FIG. 5, there is a conical lip 60 formed on the end of pour spout tube 48 which is shaped to correspond to the conical outlet 46 of the container. There are a pair of ribs 62 formed longitudinally along pour spout 48. Ribs 62 engage in corresponding notches 64 formed in conical outlet 46 to prevent pour spout 48 from rotating.

Threads 52 and 54 which interlock sealing cap 50 on neck 42 have only one turn. Threads 56 and 58 formed between the inner cap 50*a* and pour spout 48 have three turns. In this manner, sealing cap 50 may be disengaged from neck 42 and extended fully as shown in FIG. 6. With ribs 62 interlocked in notches 64, pour spout 48 is prevented from rotating. Sealing cap 50 may then be disengaged from the end of pour spout 48 without the need of holding the pour spout 48. In this manner soiling of the hands does not occur due to the anti-turning means provided by the ribs 62 and notches 64. This is highly preferable since an object of the invention is to provide a container and method by which fluid may be dispensed from a container and into a remote and inaccessible filling opening without the user's hands becoming dirty or without the soiling of clothing.

While a preferred embodiment of the invention has been described using specific terms, such description is for illustrative purposes only, and it is to be understood that changes and variations may be made without departing from the spirit or scope of the following claims.

What is claimed is:

1. A container having a pull-out pouring spout for dispensing a fluid from the container into a remote filling opening, comprising:

(a) a container having an interior cavity for containing a fluid;

(b) a neck formed integrally with said container having threads formed about its exterior;

(c) an extendable and retractable pouring spout. formed integrally with said container of a flexible material, at least partially disposed within said interior cavity, having threads formed about the exterior of the dispensing end of said pouring spout; and (d) a sealing cap having a first set of threads for engaging the threads on said neck and a second set of threads for engaging the threads on said spout dispensing end, said second set of threads having a greater number of turns than said first set of threads so that said cap may be removed from said neck without being removed from said pouring spout so that said pouring spout may be pulled out of said interior cavity by grasping said sealing cap whereby the user does not contact said pouring spout with his hands.

2. A container as set forth in claim 1 wherein said pouring spout is formed of a plastic material.

3. A container as set forth in claim 1 wherein said container and said neck are formed from a rigid plastic material.

4. A container as set forth in claim 1 wherein the first set of threads and the second set of threads on said sealing cap are selected so as to seal the end of the spout and the end of said neck.

5. A method of dispensing fluid from a container to a remote and inaccessable filling opening which includes providing a container with a threaded neck, wherein the method comprises the following steps:

(a) providing a pouring spout in said container, formed integrally therewith, which may be stored in said container and withdrawn through said neck to an extended position for dispensing fluid into said filling opening said pouring spout having a threaded dispensing end;

(b) providing a sealing cap having a first set of threads for attachment to said neck of said container and a second set of threads for attachment to the dispensing end of said pouring spout;

(c) threadedly attaching said sealing cap to said container neck and said pour spout dispensing end;

(d) unthreading said cap from said neck while maintaining a partial threaded engagement between said cap and said pouring spout end;

(e) pulling said pouring spout from said container by grasping the still-attached cap only;

(f) unthreading said cap from said pouring spout end; and (g) dispensing fluid from said container through said pouring spout.

6. The method of claim 5, including providing said cap with a greater number of turns of threads in said second set than are provided for said first set.

7. A method of dispensing fluid from a container to a remote and inaccessible filling opening, said container comprising a fluid holding cavity, an externally threaded neck portion, an open-ended externally threaded pouring spout formed integrally with said container, at least partially disposed within said cavity, and a sealing cap having a first set of threads for engaging said threaded neck portion and a second set of threads, having more turns than said first set for engaging said threaded open-ended portion of said pouring spout, comprising the following steps:

(a) holding said container against rotation;

(b) rotating said sealing cap until it is disengaged from said neck but is still engaged to said end of said spout;

(c) grasping said cap and withdrawing said pouring spout from within said cavity;

(d) further rotating said sealing cap to disengage it from said end of said pouring spout; and (e) tilting said container to dispense fluid contained within said cavity through said pouring spout.

* * * * *